US009921507B2

(12) United States Patent
Murakami

(10) Patent No.: US 9,921,507 B2
(45) Date of Patent: Mar. 20, 2018

(54) ELECTROSTATIC-IMAGE DEVELOPING TONER, ELECTROSTATIC-IMAGE DEVELOPER, AND TONER CARTRIDGE

(71) Applicant: FUJI XEROX CO., LTD., Tokyo (JP)

(72) Inventor: Tsuyoshi Murakami, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/221,000

(22) Filed: Jul. 27, 2016

(65) Prior Publication Data

US 2017/0277073 A1 Sep. 28, 2017

(30) Foreign Application Priority Data

Mar. 22, 2016 (JP) ..... 2016-057468

(51) Int. Cl.

| | |
|---|---|
| ***G03G 9/093*** | (2006.01) |
| ***G03G 9/087*** | (2006.01) |
| ***G03G 9/08*** | (2006.01) |
| ***G03G 9/113*** | (2006.01) |

(52) U.S. Cl.

CPC ..... *G03G 9/09371* (2013.01); *G03G 9/0804* (2013.01); *G03G 9/0819* (2013.01); *G03G 9/0825* (2013.01); *G03G 9/0827* (2013.01); *G03G 9/08711* (2013.01); *G03G 9/08755* (2013.01); *G03G 9/09364* (2013.01); *G03G 9/1139* (2013.01)

(58) Field of Classification Search

CPC ..... G03G 9/08711; G03G 9/0821; G03G 9/08755; G03G 9/08782; G03G 9/09364; G03G 9/09371; G03G 9/0825; G03G 9/0827; G03G 9/0804

USPC ..... 430/109.4, 109.3

See application file for complete search history.

(56) References Cited

U.S. PATENT DOCUMENTS

| | | | | |
|---|---|---|---|---|
| 5,797,070 | A * | 8/1998 | Waki | G03G 15/0194 399/149 |
| 6,303,257 | B1 * | 10/2001 | Hasegawa | G03G 9/08711 430/109.3 |
| 2013/0288173 | A1 * | 10/2013 | Hashimoto | G03G 9/08755 430/109.3 |
| 2015/0268573 | A1 * | 9/2015 | Iwazaki | G03G 9/0806 430/105 |

FOREIGN PATENT DOCUMENTS

| | | |
|---|---|---|
| JP | 2009-300710 A | 12/2009 |

* cited by examiner

*Primary Examiner* — Janis L Dote
(74) *Attorney, Agent, or Firm* — Oliff PLC

(57) ABSTRACT

An electrostatic-image developing toner includes toner particles each including a polyester resin and a styrene (meth) acrylic resin. In a micro-compression test where a load of 0.2 mN is applied to the toner particles at a loading rate of 0.098 mN/sec, the median of a distribution of the ratios (%) of deformations of the toner particles to the diameters of the toner particles is 8.0 or more and 18.0 or less, and a variation in the distribution of the ratios of deformations of the toner particles to the diameters of the toner particles is 0.02 or more and 0.40 or less.

20 Claims, 3 Drawing Sheets

ELECTROSTATIC-IMAGE DEVELOPING TONER, ELECTROSTATIC-IMAGE DEVELOPER, AND TONER CARTRIDGE

CROSS-REFERENCE TO RELATED APPLICATIONS

This application is based on and claims priority under 35 USC 119 from Japanese Patent Application No. 2016-057468 filed Mar. 22, 2016.

BACKGROUND (i) Technical Field

The present invention relates to an electrostatic-image developing toner, an electrostatic-image developer, and a toner cartridge.

(ii) Related Art

Methods for visualizing image information, such as electrophotography, have been used in various fields. In electrophotography, an electrostatic image, that is, image information, is formed on the surface of an image carrier through charging and electrostatic-image-forming steps. The electrostatic image is developed with a developer including a toner, and a toner image is formed on the surface of the image carrier. The toner image is transferred to a recording medium and subsequently fixed to the recording medium. The image information is visualized through the above steps.

SUMMARY

According to an aspect of the invention, there is provided an electrostatic-image developing toner including toner particles each including a polyester resin and a styrene (meth) acrylic resin. In a micro-compression test where a load of 0.2 mN is applied to the toner particles at a loading rate of 0.098 mN/sec, the median of a distribution of the ratios (%) of deformations of the toner particles to the diameters of the toner particles is 8.0 or more and 18.0 or less, and a variation in the distribution of the ratios of deformations of the toner particles to the diameters of the toner particles is 0.02 or more and 0.40 or less.

BRIEF DESCRIPTION OF THE DRAWINGS

Exemplary embodiments of the present invention will be described in detail based on the following figures, wherein.

DETAILED DESCRIPTION

Figure 1:
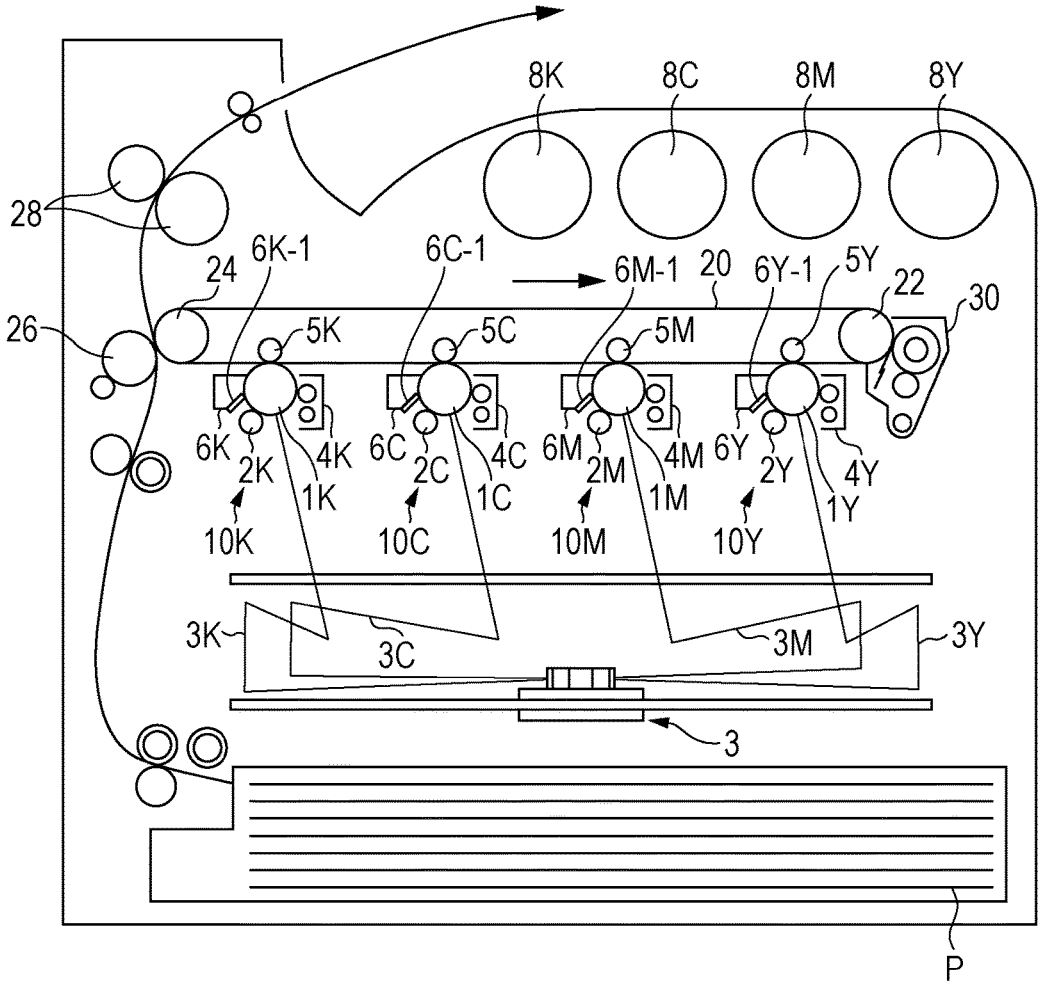
FIG. 1 is a schematic diagram illustrating an example of an image forming apparatus according to an exemplary embodiment.

Exemplary embodiments of the invention are described below.

Electrostatic-Image Developing Toner

An electrostatic-image developing toner according to an exemplary embodiment (hereinafter, referred to simply as "toner") includes toner particles each including a polyester resin and a styrene (meth)acrylic resin. In a micro-compression test where a load of 0.2 mN is applied to the toner particles at a loading rate of 0.098 mN/sec, the median of the distribution of the ratios (%) of deformations of the toner particle to the diameters of the toner particles (hereinafter, this "ratios" is referred to as "deformation ratios") is 8.0 or more and 18.0 or less, and the variation in the distribution of the deformation ratios is 0.02 or more and 0.40 or less.

A toner having the above-described structure is considered to reduce the likelihood of streaky image defects being formed in the direction of rotation of an image carrier when images having different area coverages are formed with an image forming apparatus including a cleaning blade that is in contact with the image carrier at a low contact pressure in a low-temperature, low-humidity environment for the following reasons.

Attempts have been made to reduce the contact pressure at which a cleaning blade (hereinafter, referred to simply as "blade") is brought into contact with an image carrier to, for example, 10.2 mN/mm or more and 20.0 mN/mm or less in order to increase the service life of the image carrier. However, when images having different area coverages are formed with such an image forming apparatuses including a blade, in particular, in a low-temperature, low-humidity environment (e.g., 10° C. and 15% RH), streaky image defects may be formed in the direction of rotation of an image carrier. It is considered that this phenomenon is caused by the following mechanisms. Commonly, a suitable amount of toner components, such as toner particles and external additive particles, are likely to pass through a portion at which an image carrier and a blade come into contact with each other (hereinafter, this portion is referred to as "blade nip portion") and form a residue, which stabilizes the position of the blade. However, when the amount of toner fed onto the image carrier is changed due to variations in the area coverage at which images are formed, it becomes difficult to stabilize the position of the blade and, as a result, the blade may jump in the direction of rotation of the image carrier.

There have been proposed toners including toner particles that are made to become deformed within a specific range when being compressed. Using toner particles that deforms greatly when being compressed increases the likelihood of the toner particles passing through the blade nip portion toward the back of the blade nip portion, that is, downstream in the direction of rotation of the image carrier. However, when images are formed at a high area coverage, an excessive amount of toner particles may pass through the blade nip portion toward the back of the blade nip portion. This makes the position of the blade unstable and increases the likelihood of the blade jumping in the direction of rotation of the image carrier. On the other hand, using toner particles that do not deform greatly when being compressed reduces the likelihood of the toner particles passing through the blade nip portion toward the back of the blade nip portion, and the shortage of toner particles fed toward the back of the blade nip portion may occur when images are formed at a low area coverage. This again makes the position of the blade unstable and increases the likelihood of the blade jumping in the direction of rotation of the image carrier as is the case where toner particles that deform greatly when being compressed are used.

As described above, in an image forming apparatus including a blade that is in contact with an image carrier at a low contact pressure, variations in the area coverage of the images that are to be formed may cause streaky image defects to be formed in the direction of rotation of the image carrier even when toner particles that are made to become deformed within a specific range when being compressed are used.

The median of the distribution of the ratios (%) of deformations of the toner particles to the diameters of the toner particles which is determined in a micro-compression test is a measure of the overall flexibility of the toner particles. The variation in the distribution of the ratios of deformations of the toner particles to the diameters of the toner particles is a measure of the proportions of hard toner particles and soft toner particles in the toner particles, which have flexibility that deviates from the median.

Specifically, controlling the median of the distribution of the ratios (%) of deformations of the toner particles to the diameters of the toner particles to be 8.0 or more and 18.0 or less enables the toner particles to have flexibility with which a suitable amount of the toner particles may pass through the blade nip portion. Controlling the variation in the distribution of the deformation ratios to be 0.02 or more and 0.40 or less enables the proportions of hard toner particles and soft toner particles to be appropriate.

In other words, when the median of the distribution of the ratios (%) of deformations of the toner particles to the diameters of the toner particles and the variation in the distribution of the deformation ratios are each controlled to be within the above range, the hard toner particles limit an excessive increase in the amount of toner particles that pass through the blade nip portion toward the back of the blade nip portion which may occur in the case where images having a high area coverage are formed, and the soft toner particles limit the shortage of toner particles that pass through the blade nip portion which may occur in the case where images having a low area coverage are formed. This stabilizes the position of the blade and reduces the likelihood of the blade jumping in the direction of rotation of the image carrier regardless of the area coverage at which images are formed.

Furthermore, the toner particles each include a polyester resin and a styrene (meth)acrylic resin that serve as binder resins. This enables the distribution of the flexibility of the toner particles to be controlled and makes it easy to control the median of the distribution of the ratios (%) of deformations of the toner particles to the diameters of the toner particles and the variation in the distribution of the deformation ratios to be within the above ranges.

For the above-described reasons, a toner having the above-described structure is considered to reduce the likelihood of streaky image defects being formed in the direction of rotation of an image carrier when images having different area coverages are formed with an image forming apparatus including a cleaning blade that is in contact with the image carrier at a low contact pressure in a low-temperature, low-humidity environment.

One of the known techniques for controlling the ratio of the deformation of toner particles to the diameter of the toner particles is a method in which toner particles each including a soft core and a hard shell that covers the core are produced by suspension polymerization (e.g., Japanese Unexamined Patent Application Publication No. 2009-300710). However, in this technique using suspension polymerization, toner particles are produced in a reaction system that are made substantially uniform, and the variation in the distribution of the ratios of deformations of toner particles to the diameter of the toner particles is not controlled.

The toner according to this exemplary embodiment is described below in detail.

The toner according to this exemplary embodiment includes toner particles. The toner may optionally include an external additive.

Toner Particles

The median of the distribution of the ratios (%) of deformations of the toner particles to the diameters of the toner particles is 8.0 or more and 18.0 or less, is preferably 9.0 or more and 17.0 or less, and is more preferably 10.0 or more and 16.0 or less in order to reduce the occurrence of the streaky image defects.

The variation in the distribution of the deformation ratios is 0.02 or more and 0.40 or less, is preferably 0.05 or more and 0.35 or less, and is more preferably 0.10 or more and 0.30 or less in order to reduce the occurrence of the streaky image defects.

For controlling the median of the distribution of the ratios (%) of deformations of the toner particles to the diameters of the toner particles and the variation in the distribution of the deformation ratios to each fall within the above range, for example, the ratio of the amount of styrene (meth)acrylic resin to the amount of polyester resin that serve as binder resins constituting the toner particles may be changed in the production of the toner particles.

The median of the distribution of the ratios (%) of deformations of the toner particles to the diameters of the toner particles and the variation in the distribution of the deformation ratios are determined by the micro-compression test described below.

The micro-compression test is conducted in an environment of 22° C. and 55% RH with a nanoindentation hardness tester "ENT1100" produced by Elionix Inc. equipped with a 20-μm-square, flat indenter.

Specifically, the toner particles to be measured are applied to a ceramic cell so as to be dispersed thereon.

The resulting cell is attached to the nanoindentation hardness tester.

A load of 0.2 mN is applied at a loading rate of 0.098 mN/sec to one of the toner particles which is selected on a display of the nanoindentation hardness tester. The deformation of the toner particle is measured. In other words, a load is applied to the toner particle at a rate of 0.098 mN/sec, and the deformation of the toner particle is measured when the load reaches 0.2 mN. Subsequently, the diameter of the toner particle is measured, and the ratio of the deformation of the toner particle to the diameter of the toner particle is calculated using the following formula:

$$\text{Deformation Ratio}=[\text{Deformation of Toner Particles}]/[\text{Diameter of Toner Particle}]\times 100$$

The diameter of a toner particle is determined from the lengths of the longer and shorter axes of the toner particle by using the following formula with software attached to the nanoindentation hardness tester:

$$\text{Diameter of Toner Particle}=([\text{Length of Longer Axis of Toner Particle}]+[\text{Length of Shorter Axis of Toner Particle}])/2$$

The above operation is repeated for 500 toner particles in order to determine the distribution of the ratios (%) of deformations of the toner particles to the diameters of the toner particles and the median of the distribution. The median of the distribution is determined in the following manner: deformation ratios (%) are rounded in 0.1 percent units; the deformation ratios of the 500 toner particles are sorted in ascending order; and the arithmetic average of the deformation ratios (%) of the 250th and 251st toner particles is considered to be the median of the distribution.

The variation in the distribution of the deformation ratios is determined from the distribution of the ratios of deformations of the toner particles to the diameters of the toner particles in the following manner: the deformation ratios (%) of the 500 toner particles are rounded in 0.1 percent units; the deformation ratios of the 500 toner particles are sorted in ascending order in order to prepare a frequency distribution; and the standard deviation of the frequency distribution is divided by the average of the deformation ratios.

The toner particles each include a binder resin. The toner particles may optionally each include other additives such as a colorant and a release agent.

Binder Resin

A polyester resin and a styrene (meth)acrylic resin are used as binder resins. The ratio of the amount of the polyester resin to the amount of styrene (meth)acrylic resin, that is, polyester resin/styrene (meth)acrylic resin, is preferably 80/20 or more and 99/1 or less and is more preferably 86/14 or more and 98/2 or less in order to reduce the occurrence of the streaky image defects.

A resin other than the polyester resin or the styrene (meth)acrylic resin may be used as a binder resin. In such a case, the proportion of the amount of polyester resin and styrene (meth)acrylic resin to the total amount of binder resins may be, for example, 80% by mass or more, is preferably 90% by mass or more, is more preferably 95% by mass or more, and is further preferably 100% by mass.

The other binder resins may be used alone or in combination of two or more.

Examples of the polyester resin include various polyester resins known in the related art.

Examples of the polyester resin include condensation polymers of a polyvalent carboxylic acid and a polyhydric alcohol. The polyester resin may be a commercially available one or a synthesized one.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides of these dicarboxylic acids, and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher polyvalent carboxylic acids having a crosslinked structure or a branched structure may be used as a polyvalent carboxylic acid in combination with the dicarboxylic acid. Examples of the trivalent or higher polyvalent carboxylic acids include trimellitic acid, pyromellitic acid, anhydrides of these carboxylic acids, and lower (e.g., 1 to 5 carbon atoms) alkyl esters of these carboxylic acids.

The above polyvalent carboxylic acids may be used alone or in combination of two or more.

Examples of the polyhydric alcohol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., bisphenol A-ethylene oxide adduct and bisphenol A-propylene oxide adduct). Among these diols, for example, aromatic diols and alicyclic diols may be used as a polyhydric alcohol. In particular, aromatic diols may be used as a polyhydric alcohol.

Trihydric or higher polyhydric alcohols having a crosslinked structure or a branched structure may be used as a polyhydric alcohol in combination with the diols.

Examples of the trihydric or higher polyhydric alcohols include glycerin, trimethylolpropane, and pentaerythritol.

The above polyhydric alcohols may be used alone or in combination of two or more.

The glass transition temperature (Tg) of the polyester resin is preferably 50° C. or more and 80° C. or less and is more preferably 50° C. or more and 65° C. or less.

Glass transition temperature is determined from a DSC curve obtained by differential scanning calorimetry (DSC). More specifically, glass transition temperature is determined from the "extrapolated glass-transition-starting temperature" according to a method for determining glass transition temperature which is described in JIS K 7121-1987 "Testing Methods for Transition Temperatures of Plastics".

The weight-average molecular weight (Mw) of the polyester resin is preferably 5,000 or more and 1,000,000 or less and is more preferably 7,000 or more and 500,000 or less.

The number-average molecular weight (Mn) of the polyester resin is preferably 2,000 or more and 100,000 or less.

The molecular weight distribution (Mw/Mn) of the polyester resin is preferably 1.5 or more and 100 or less and is more preferably 2 or more and 60 or less.

The weight-average molecular weight and number-average molecular weight of the polyester resin are determined by gel permeation chromatography (GPC). Specifically, the molecular weights of the polyester resin are determined by GPC using a GPC "HLC-8120GPC" produced by Tosoh Corporation as measuring equipment, a column "TSKgel SuperHM-M (15 cm)" produced by Tosoh Corporation, and tetrahydrofuran (THF) as a solvent. The weight-average molecular weight and number-average molecular weight of the polyester resin are determined on the basis of the results of the measurement using a molecular-weight calibration curve based on monodisperse polystyrene standard samples.

The polyester resin may be produced by any suitable production method known in the related art. Specifically, the polyester resin may be produced by, for example, a method in which polymerization is performed at 180° C. or more and 230° C. or less and the pressure inside the reaction system is reduced as needed while water and alcohols that are generated by condensation are removed.

In the case where the raw materials, that is, monomers, are not dissolved or compatible with each other at the reaction temperature, a solvent having a high boiling point may be used as a dissolution adjuvant in order to dissolve the raw materials. In such a case, condensation polymerization is performed while the dissolution adjuvant is distilled away. In the case where the monomers used for copolymerization have low compatibility with each other, a condensation reaction of the monomers with an acid or alcohol that is to undergo a polycondensation reaction with the monomers may be performed in advance and subsequently a polycondensation of the resulting polymers with the main components may be performed.

The styrene (meth)acrylic resin is a copolymer produced by copolymerization of at least a polymerizable monomer including a styrene structure (hereinafter, referred to as "styrene-based polymerizable monomer) and a polymerizable monomer including a (meth)acryloyl structure (hereinafter, referred to as "(meth)acrylic acid-based polymerizable monomer).

The term "(meth)acrylic" used herein refers to both "acrylic" and "methacrylic".

Examples of the styrene-based polymerizable monomer include styrene, alkyl-substituted styrenes (e.g., α-methylstyrene, 2-methylstyrene, 3-methylstyrene, 4-methylstyrene, 2-ethylstyrene, 3-ethylstyrene, and 4-ethylstyrene), halogen-substituted styrenes (e.g., 2-chlorostyrene, 3-chlorostyrene, and 4-chlorostyrene), and vinylnaphthalene. These styrene-based polymerizable monomers may be used alone or in combination of two or more.

Among these styrene-based polymerizable monomers, in particular, styrene may be used from the viewpoints of reactivity, ease of controlling a reaction, and availability.

Examples of the (meth)acrylic acid-based polymerizable monomer include (meth)acrylic acid and (meth)acrylates. Examples of the (meth)acrylates include alkyl (meth)acrylates (e.g., methyl (meth)acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth)acrylate, 2-ethylhexyl (meth)acrylate, cyclohexyl (meth)acrylate, and t-butylcyclohexyl (meth)acrylate); aryl (meth)acrylates (e.g., phenyl (meth)acrylate, biphenyl (meth)acrylate, diphenylethyl (meth)acrylate, t-butylphenyl (meth)acrylate, and terphenyl (meth)acrylate); dimethylaminoethyl (meth)acrylate; diethylaminoethyl (meth)acrylate; methoxyethyl (meth)acrylate; 2-hydroxyethyl (meth)acrylate; β-carboxyethyl (meth)acrylate; and (meth)acrylamide. The above (meth)acrylic acid-based polymerizable monomers may be used alone or in combination of two or more.

The ratio of the styrene-based polymerizable monomer to the (meth)acrylic acid-based polymerizable monomer in copolymerization (i.e., styrene-based polymerizable monomer/(meth)acrylic acid-based polymerizable monomer, on a mass basis) may be, for example, 85/15 to 70/30.

The styrene (meth)acrylic resin may have a crosslinked structure. An example of a styrene (meth)acrylic resin having a crosslinked structure is a crosslinked product produced by copolymerization of at least the styrene-based polymerizable monomer, the (meth)acrylic acid-based polymerizable monomer, and a crosslinking monomer.

Examples of the crosslinking monomer include bifunctional or polyfunctional crosslinking agents.

Examples of bifunctional crosslinking agents include divinylbenzene, divinylnaphthalene, di(meth)acrylate compounds (e.g., diethylene glycol di(meth)acrylate, methylene-bis(meth)acrylamide, decanediol diacrylate, and glycidyl (meth)acrylate), polyester-type di(meth)acrylate, and methacrylic acid-2-([1'-methylpropylideneamino]carboxyamino) ethyl.

Examples of polyfunctional crosslinking agents include tri(meth)acrylate compounds (e.g., pentaerythritol tri(meth) acrylate, trimethylolethane tri(meth)acrylate, and trimethylolpropane tri(meth)acrylate), tetra(meth)acrylate compounds (e.g., tetramethylolmethane tetra(meth)acrylate and oligoester (meth)acrylate), 2,2-bis(4-methacryloxy polyethoxyphenyl)propane, diallyl phthalate, triallyl cyanurate, triallyl isocyanurate, triallyl trimellitate, and diallyl chlorendate.

The ratio of the crosslinking monomer to the all monomers in copolymerization (i.e., crosslinking monomer/all monomers, on a mass basis) may be, for example, 2/1,000 to 30/1,000.

The glass transition temperature (Tg) of the styrene (meth)acrylic resin may be, for example, 50° C. or more and 75° C. or less, is preferably 55° C. or more and 65° C. or less, and is more preferably 57° C. or more 60° C. or less from the viewpoint of the fixability of the toner.

Glass transition temperature is determined from a DSC curve obtained by differential scanning calorimetry (DSC). More specifically, glass transition temperature is determined from the "extrapolated glass-transition-starting temperature" according to a method for determining glass transition temperature which is described in JIS K 7121-1987 "Testing Methods for Transition Temperatures of Plastics".

The weight-average molecular weight of the styrene (meth)acrylic resin is, for example, 30,000 or more and 200,000 or less, is preferably 40,000 or more and 100,000 or less, and is more preferably 50,000 or more and 80,000 or less from the viewpoint of the preservation stability of the toner.

Weight-average molecular weight is determined by gel permeation chromatography (GPC). Specifically, molecular weight is determined by GPC using a GPC "HLC-8120GPC" produced by Tosoh Corporation as measuring equipment, a column "TSKgel SuperHM-M (15 cm)" produced by Tosoh Corporation, and tetrahydrofuran (THF) as a solvent. Weight-average molecular weight is determined on the basis of the results of the measurement using a molecular-weight calibration curve based on monodisperse polystyrene standard samples.

Examples of the other binder resins include vinyl resins that are other than the styrene (meth)acrylic resin. Examples of such vinyl resins include homopolymers of the following monomers or copolymers of two or more monomers selected from the following monomers: styrenes (e.g., styrene, parachlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene).

Examples of the other binder resins also include non-vinyl resins such as epoxy resins, polyester resins, polyurethane resins, polyamide resins, cellulose resins, polyether resins, and modified rosins; a mixture of the non-vinyl resin and the vinyl resin; and a graft polymer produced by polymerization of the vinyl monomer in the presence of the non-vinyl resin.

The content of the binder resin is, for example, preferably 40% by mass or more and 95% by mass or less, is more preferably 50% by mass or more and 90% by mass or less, and is further preferably 60% by mass or more and 85% by mass or less of the total amount of toner particles.

Colorant

Examples of the colorant include various pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The above colorants may be used alone or in combination of two or more.

The colorant may optionally be subjected to a surface treatment and may be used in combination with a dispersant. Plural types of colorants may be used in combination.

The content of the colorant is preferably, for example, 1% by mass or more and 30% by mass or less and is more preferably 3% by mass or more and 15% by mass or less of the total amount of toner particles.

Release Agent

Examples of the release agent include, but are not limited to, hydrocarbon waxes; natural waxes such as a carnauba wax, a rice bran wax, and a candelilla wax; synthetic or mineral-petroleum-derived waxes such as a montan wax; and ester waxes such as a fatty-acid ester wax and a montanate wax.

The melting temperature of the release agent is preferably 50° C. or more and 110° C. or less and is more preferably 60° C. or more and 100° C. or less.

The melting temperature of the release agent is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The content of the release agent is preferably, for example, 1% by mass or more and 20% by mass or less and is more preferably 5% by mass or more and 15% by mass or less of the total amount of toner particles.

Other Additives

Examples of the other additives include various additives known in the related art, such as a magnetic substance, a charge-controlling agent, and an inorganic powder. These additives may be added to the toner particles as internal additives.

Properties, etc. of Toner Particles

The toner particles may have a single-layer structure or a "core-shell" structure constituted by a core (i.e., core particle) and a coating layer (i.e., shell layer) covering the core.

The core-shell structure of the toner particles may be constituted by, for example, a core including the binder resin and, as needed, other additives such as a colorant and a release agent and by a coating layer including the binder resin.

The volume-average diameter (D50v) of the toner particles is preferably 2 μm or more and 10 μm or less and is more preferably 4 μm or more and 8 μm or less.

The average diameters and particle diameter distribution indices of the toner particles are measured using "COULTER MULTISIZER II" produced by Beckman Coulter, Inc. with an electrolyte "ISOTON-II" produced by Beckman Coulter, Inc. in the following manner.

A sample (0.5 mg or more and 50 mg or less) is added to 2 ml of a 5%-aqueous solution of a surfactant such as sodium alkylbenzene sulfonate that serves as a dispersant. The resulting mixture is added to 100 ml or more and 150 ml or less of the electrolyte.

The resulting electrolyte containing the sample suspended therein is subjected to a dispersion treatment for 1 minute with an ultrasonic disperser, and the distribution of the diameters of particles having a diameter of 2 μm or more and 60 μm or less is measured using a COULTER Multisizer II with an aperture having a diameter of 100 μm. The number of the particles sampled is 50,000.

The particle diameter distribution measured is divided into a number of particle diameter ranges (i.e., channels). For each range, in ascending order in terms of particle diameter, the cumulative volume and the cumulative number are calculated and plotted to draw cumulative distribution curves. Particle diameters at which the cumulative volume and the cumulative number reach 16% are considered to be the volume particle diameter D16v and the number particle diameter D16p, respectively. Particle diameters at which the cumulative volume and the cumulative number reach 50% are considered to be the volume-average particle diameter D50v and the number-average particle diameter D50p, respectively. Particle diameters at which the cumulative volume and the cumulative number reach 84% are considered to be the volume particle diameter D84v and the number particle diameter D84p, respectively.

Using the volume particle diameters and number particle diameters measured, the volume-average particle diameter distribution index (GSDv) is calculated as $(D84v/D16v)^{1/2}$ and the number-average particle diameter distribution index (GSDp) is calculated as $(D84p/D16p)^{1/2}$.

The shape factor (SF1) of the toner particles is preferably 110 or more and 150 or less and is more preferably 120 or more and 140 or less.

The shape factor SF1 of the toner particles is determined using the following formula:

$$SF1=(ML^2/A)\times(\pi/4)\times 100$$

where ML represents the absolute maximum length of the toner particles and A represents the projected area of the toner particles.

Specifically, the shape factor SF1 of the toner particles is determined by analyzing a microscope image or scanning electron microscope (SEM) image of the toner particles using an image processor in the following manner. An optical microscope image of toner particles spread over the surface of a glass slide is loaded into a LUZEX image processor using a video camera. The maximum lengths and projected areas of 100 toner particles are measured. The shape factors SF1 of the 100 toner particles are calculated using the above formula, and the average of the shape factors SF1 is obtained.

External Additive

Examples of the external additive include inorganic particles such as $SiO_2$ particles, $TiO_2$ particles, $Al_2O_3$ particles, CuO particles, ZnO particles, $SnO_1$ particles, $CeO_2$ particles, $Fe_2O_3$ particles, MgO particles, BaO particles, CaO particles, $K_2O$ particles, $Na_2O$ particles, $ZrO_2$ particles, CaO—$SiO_2$ particles, $K_2O.(TiO_2)_n$ particles, $Al_2O_3.2SiO_2$ particles, $CaCO_3$ particles, $MgCO_3$ particles, $BaSO_4$ particles, and $MgSO_4$ particles.

The surfaces of the inorganic particles used as an external additive may be hydrophobized. The surfaces of the inorganic particles can be hydrophobized by, for example, immersing the inorganic particles in a hydrophobizing agent. Examples of the hydrophobizing agent include, but are not particularly limited to, a silane coupling agent, silicone oil, a titanate coupling agent, and aluminium coupling agent. These hydrophobizing agents may be used alone or in combination of two or more.

In general, the amount of the hydrophobizing agent is set to, for example, 1 part by mass or more and 10 parts by mass or less relative to 100 parts by mass of the inorganic particles.

Examples of the external additive also include resin particles such as polystyrene particles, polymethyl methacrylate (PMMA) particles, and melamine particles; and cleaning activators (e.g., particles of a metal salt of a higher fatty acid, such as zinc stearate, and particles of a fluorine-based polymer).

The amount of the external additive is, for example, preferably 0.01% by mass or more and 5% by mass or less and is more preferably 0.01% by mass or more and 2.0% by mass or less of the amount of toner particles.

Method for Producing Toner

For producing the toner according to this exemplary embodiment, toner particles only may be produced and used as a toner. In the production of the toner, alternatively, an external additive may optionally be deposited on the surfaces of the toner particles.

For producing the toner particles, both dry processes such as knead pulverization and wet processes such as coagulation coalescence, suspension polymerization, and dissolution suspension may be employed. The above production methods are not limited, and known production methods may be employed.

For producing toner particles, in particular, the coagulation coalescence method described below may be employed in order to produce a toner (i.e., toner particles) that has the above-described characteristics (i.e., median and variation) of the distribution of the ratios (%) of deformations of the toner particles to the diameters of the toner particles.

Specifically, the coagulation coalescence method includes the following steps:

a dispersion preparation step in which various types of dispersions are prepared;

a first aggregated particle formation step in which a first polyester resin particle dispersion including first polyester resin particles (hereinafter, the first polyester resin particles may be referred to as "first PE resin particles" and the first polyester resin particle dispersion may be referred to as "first PE resin particle dispersion"), a first styrene (meth)acrylic resin particle dispersion including first styrene (meth)acrylic resin particles (hereinafter, the first styrene (meth)acrylic resin particles may be referred to as "first StAc resin particles" and the first styrene (meth)acrylic resin particle dispersion may be referred to as "first StAc resin particle dispersion"), a colorant particle dispersion including colorant particles, and a release-agent particle dispersion including release-agent particles are mixed together, and coagulation of the above particles is performed in the resulting mixed dispersion in order to form first aggregated particles;

a second aggregated particle formation step in which, subsequent to the formation of a first aggregated particle dispersion including the first aggregated particles, a mixed dispersion including second polyester resin particles (hereinafter, referred to as "second PE resin particles") and second styrene (meth)acrylic resin particles (hereinafter, referred to as "second StAc resin particles") is added to the first aggregated particle dispersion sequentially, and the second PE resin particles and the second StAc resin particles are deposited on the surfaces of the first aggregated particles in order to form second aggregated particles; and a fusion-coalescence step in which a second aggregated particle dispersion including the second aggregated particles is heated in order to perform fusion coalescence of the second aggregated particles and form toner particles.

The first aggregated particles do not necessarily include the first StAc resin particles. In other words, the first StAc resin particle dispersion is not necessarily used in the formation of the first aggregated particles.

The above steps are described below in detail.

Dispersion Preparation Step

Dispersions used in the coagulation coalescence method are prepared. Specifically, the first PE resin particle dispersion, the second PE resin particle dispersion, the first StAc resin particle dispersion, the second StAc resin particle dispersion, the colorant particle dispersion, and a release-agent particle dispersion including the release-agent particles are prepared.

In descriptions of the dispersion preparation step below, the above resin particles are collectively referred to simply as "resin particles".

The resin particle dispersion is prepared by, for example, dispersing resin particles in a dispersion medium by using a surfactant.

Examples of the dispersion medium used for preparing the resin particle dispersion include aqueous media.

Examples of the aqueous media include water such as distilled water and ion-exchange water and alcohols. These aqueous media may be used alone or in combination of two or more.

Examples of the surfactant include anionic surfactants such as sulfate-based surfactants, sulfonate-based surfactants, and phosphate-based surfactants; cationic surfactants such as amine-salt-based surfactants and quaternary-ammonium-salt-based surfactants; and nonionic surfactants such as polyethylene-glycol surfactants, alkylphenol-ethylene-oxide-adduct-based surfactants, and polyhydric-alcohol-based surfactants. Among these surfactants, in particular, the anionic surfactants and the cationic surfactants may be used. The nonionic surfactants may be used in combination with the anionic surfactants and the cationic surfactants.

These surfactants may be used alone or in combination of two or more.

In the preparation of the resin particle dispersion, the resin particles can be dispersed in a dispersion medium by any suitable dispersion method commonly used in the related art in which, for example, a rotary-shearing homogenizer, a ball mill, a sand mill, or a dyno mill that includes media is used. Depending on the type of the resin particles used, the resin particles may be dispersed in the resin particle dispersion by, for example, phase-inversion emulsification.

Phase-inversion emulsification is a method in which the resin to be dispersed is dissolved in a hydrophobic organic solvent in which the resin is soluble, a base is added to the resulting organic continuous phase (i.e., O phase) to perform neutralization, subsequently an aqueous medium (i.e., W phase) is charged to convert the resin, that is, to invert a phase thereof, from W/O to O/W, in order to create a discontinuous phase, and thereby the resin is dispersed in the aqueous medium in the form of particles.

The volume-average diameter of the resin particles dispersed in the resin particle dispersion is preferably set to, for example, 0.01 μm or more and 1 μm or less, is more preferably set to 0.08 μm or more and 0.3 μm or less, and is further preferably set to 0.1 μm or more and 0.6 μm or less.

The volume-average diameter of the resin particles is determined in the following manner. The particle diameter distribution of the resin particles is measured using a laser-diffraction-type particle-diameter-distribution measurement apparatus (e.g., "LA-700" produced by HORIBA, Ltd.). The particle diameter distribution measured is divided into a number of particle diameter ranges (i.e., channels). For each range, in ascending order in terms of particle diameter, the cumulative volume is calculated and plotted to draw cumulative distribution curve. A particle diameter at which the cumulative distribution is 50% relative to all particles is considered to be the volume-average diameter D50v. The volume-average diameters of particles included in the other dispersions are also determined in the above-described manner.

The content of the resin particles included in the resin particle dispersion is preferably set to, for example, 5% by mass or more and 50% by mass or less and is more preferably set to 10% by mass or more and 40% by mass or less.

The colorant particle dispersion, the release-agent particle dispersion, and the like are also prepared as in the preparation of the resin particle dispersion. In other words, the above-described specifications for the volume-average diameter of the particles included in the resin particle dispersion, the dispersion medium of the resin particle dispersion, the dispersion method used for preparing the resin particle dispersion, and the content of the particles in the resin particle dispersion can also be applied to colorant particles dispersed in the colorant particle dispersion and release-agent particles dispersed in the release-agent particle dispersion.

First Aggregated Particle Formation Step

The first PE resin particle dispersion is mixed with the first StAc resin particle dispersion, the colorant particle dispersion, and the release-agent particle dispersion.

In the resulting mixed dispersion, heteroaggregation of the first PE resin particles with the StAc resin particles, the colorant particles, and the release-agent particles is performed in order to form first aggregated particles.

Specifically, for example, a flocculant is added to the mixed dispersion, and the pH of the mixed dispersion is controlled to be acidic (e.g., pH of 2 or more and 5 or less). A dispersion stabilizer may be added to the mixed dispersion as needed. Subsequently, the mixed dispersion is heated to the glass transition temperature of the first PE resin particles (specifically, e.g., [glass transition temperature of the first PE resin particles—30° C.] or more and [the glass transition temperature—10° C.] or less), and thereby the particles dispersed in the mixed dispersion are caused to aggregate together to form first aggregated particles.

In the first aggregated particle formation step, alternatively, for example, the above-described flocculant may be added to the mixed dispersion at room temperature (e.g., 25° C.) while the mixed dispersion is stirred using a rotary-shearing homogenizer. Then, the pH of the mixed dispersion is controlled to be acidic (e.g., pH of 2 or more and 5 or less), and a dispersion stabilizer may be added to the mixed dispersion as needed. Subsequently, the mixed dispersion is heated in the above-described manner.

Examples of the flocculant include surfactants, inorganic metal salts, and divalent or higher polyvalent metal complexes that have a polarity opposite to that of the surfactant that is added to the mixed dispersion as a dispersant. In particular, using a metal complex as a flocculant reduces the amount of surfactant used and, as a result, charging characteristics may be enhanced.

An additive capable of forming a complex or a bond similar to a complex with the metal ions contained in the flocculant such as a chelating agent may optionally be used.

Examples of the inorganic metal salts include metal salts such as calcium chloride, calcium nitrate, barium chloride, magnesium chloride, zinc chloride, aluminium chloride, and aluminium sulfate; and inorganic metal salt polymers such as polyaluminium chloride, polyaluminium hydroxide, and calcium polysulfide.

The chelating agent may be a water-soluble chelating agent. Examples of such a chelating agent include oxycarboxylic acids such as tartaric acid, citric acid, and gluconic acid, imino diacid (IDA), nitrilotriacetic acid (NTA), and ethylenediaminetetraacetic acid (EDTA).

The amount of the chelating agent used is preferably 0.01 parts by mass or more and 5.0 parts by mass or less and is more preferably 0.1 parts by mass or more and less than 3.0 parts by mass relative to 100 parts by mass of the first resin particles.

Second Aggregated Particle Formation Step

Subsequent to the formation of the first aggregated particle dispersion including the first aggregated particles, a mixed dispersion including the second PE resin particles and the second StAc resin particles is sequentially added to the first aggregated particle dispersion.

The PE resin constituting the second PE resin particles may be the same as or different from the PE resin constituting the first PE resin particles. The StAc resin constituting the second StAc resin particles may be the same as or different from the StAc resin constituting the first StAc resin particles.

In the dispersion including the first aggregated particles, the second PE resin particles, and the second StAc resin particles, the second PE resin particles and the second StAc resin particles are deposited on the surfaces of the first aggregated particles. Specifically, for example, in the first aggregated particle formation step, a mixed dispersion including the second PE resin particles and the second StAc resin particles is added to the first aggregated particle dispersion when the diameter of the first aggregated particles reaches a predetermined diameter. The resulting mixed dispersion is heated at the glass transition temperature of the second PE resin particles or less.

The progress of the coagulation process is stopped by controlling the pH of the dispersion to be, for example, about 6.5 or more and 8.5 or less.

Through the above step, second aggregated particles each including the first aggregated particle and the second PE resin particles and the second StAc resin particles deposited on the surface of the first aggregated particle are formed.

When the mixed dispersion including the second PE resin particles and the second StAc resin particles is added to the first aggregated particle dispersion, for example, 1) the position, 2) the timing, and 3) the rate at which the mixed dispersion is added to the first aggregated particle dispersion and 4) the concentration of the second StAc resin particles in the mixed dispersion are changed. This enables the proportions of the second StAc resin particles deposited on the surfaces of the first aggregated particles and the distribution of the proportions of the second StAc resin particles to vary. In other words, it is possible to change the contents of the styrene (meth)acrylic resin and the distribution of the contents of the styrene (meth)acrylic resin among the toner particles, that is, to produce toner particles having different degrees of flexibility. This makes it easy to form a toner (i.e., toner particles) that has the characteristics (i.e., median and variation) of the distribution of the ratios (%) of deformations of the toner particles to the diameters of the toner particles.

For adding the mixed dispersion, a power-feed addition method may be employed. Use of a power-feed addition method enables 1) the position, 2) the timing, and 3) the rate at which the mixed dispersion is added to the first aggregated particle dispersion and 4) the concentration of the second StAc resin particles in the mixed dispersion to be controlled when the mixed dispersion is added to the first aggregated particle dispersion.

A method for adding the mixed dispersion to the first aggregated particle dispersion by using a power-feed addition method is described below with reference to the attached drawings.

Figure 3:
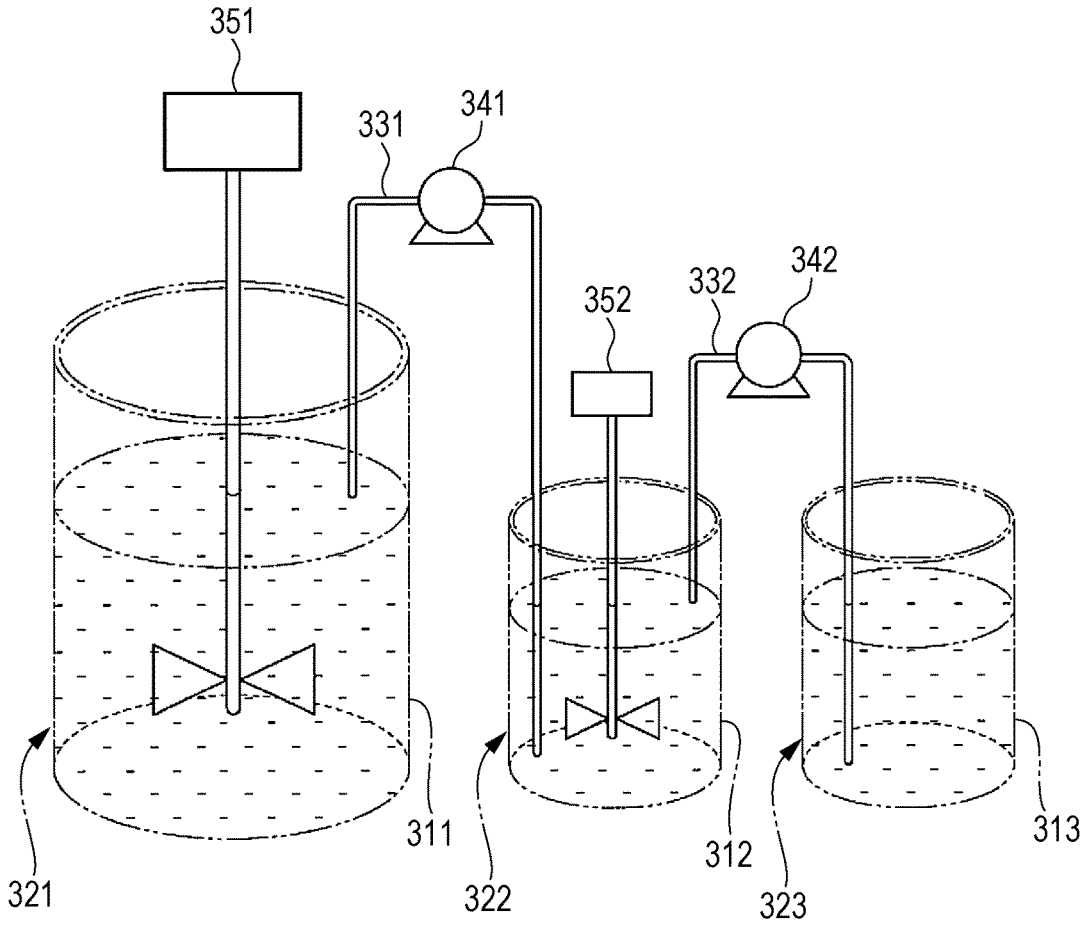
FIG. 3 is a diagram illustrating a power-feed addition method.

FIG. 3 illustrates an apparatus with which the power-feed addition method is performed.

The apparatus illustrated in FIG. 3 includes a first tank 321 containing the first aggregated particle dispersion 311 including the first aggregated particles, a second tank 322 containing the second PE resin particle dispersion 312 including the second PE resin particles, and a third tank 323 containing the second StAc resin particle dispersion 313 including the second StAc resin particles.

The first tank 321 and the second tank 322 are connected to each other with a first liquid-feeding pipe 331. A liquid-feeding pump 341 is disposed on the first liquid-feeding pipe 331. Upon the first liquid-feeding pump 341 being driven, the dispersion 312 contained in the second tank 322 is fed to the first tank 321 containing the dispersion 311 through the first liquid-feeding pipe 331.

The first tank 321 includes a first stirring device 351. Upon the first stirring device 351 being driven, the dispersion 312 fed from the second tank 322 to the first tank 321 is mixed under stirring with the dispersion 311 contained in the first tank 321.

The second tank 322 and the third tank 323 are connected to each other with a second liquid-feeding pipe 332. A second liquid-feeding pump 342 is disposed on the second liquid-feeding pipe 332. Upon the second liquid-feeding pump 342 being driven, the dispersion 313 contained in the third tank 323 is fed to the second tank 322 containing the dispersion 312 through the second liquid-feeding pipe 332.

The second tank 322 includes a second stirring device 352. Upon the second stirring device 352 being driven, the dispersion 313 fed from the third tank 323 to the second tank 322 is mixed under stirring with the dispersion 312 contained in the second tank 322.

In the apparatus illustrated in FIG. 3, the first aggregated particle formation step is conducted in the first tank 321 in order to prepare the first aggregated particle dispersion, and the first tank 321 contains the first aggregated particle dispersion. Alternatively, the first aggregated particle formation step may be performed in another tank, and the first aggregated particle dispersion may be charged into the first tank 321.

Subsequently, the first liquid-feeding pump 341 and the second liquid-feeding pump 342 start being driven. Upon the first and second liquid-feeding pumps 341 and 342 starting to be driven, the second PE resin particle dispersion contained in the second tank 322 starts being fed to the first tank 321 containing the first aggregated particle dispersion. The rotation of the first stirring device 351 causes the second PE resin particle dispersion and the first aggregated particle dispersion to be mixed together under stirring in the first tank 321.

In addition, the second StAc resin particle dispersion contained in the third tank 323 starts being fed to the second tank 322 containing the second PE resin particle dispersion. The rotation of the second stirring device 352 causes the second StAc resin particle dispersion and the second PE resin particle dispersion to be mixed together under stirring in the second tank 322.

During the above step, the second StAc resin particle dispersion is sequentially fed to the second tank 322 containing the second PE resin particle dispersion and, as a result, the concentration of the second StAc resin particles in the second tank 322 increases with time. Thus, the second tank 322 contains a mixed dispersion including the second PE resin particles and the second StAc resin particles. The mixed dispersion is fed to the first tank 321 containing the first aggregated particle dispersion.

Alternatively, feeding of the dispersion from the second tank 322 to the first tank 321 may be started after the second StAc resin particle dispersion contained in the third tank 323 has been fed to the second tank 322 containing the second PE resin particle dispersion.

In the above-described power-feed addition method, the position at which the dispersion fed from the second tank 322 is added to the first tank 321 can be controlled by changing the position of the outlet of the first liquid-feeding pipe 331. In other words, it is possible to change the position at which a mixed dispersion including the second PE resin particles and the second StAc resin particles is added to the first aggregated particle dispersion.

Furthermore, the timing at which the dispersion starts being fed from the second tank 322 to the first tank 321 can be controlled by changing the timing at which the first liquid-feeding pump 341 starts being driven. In other words, it is possible to change the timing at which a mixed dispersion including the second PE resin particles and the second StAc resin particles is added to the first aggregated particle dispersion.

Moreover, the flow rate at which the dispersion is fed from the second tank 322 to the first tank 321 can be controlled by changing the output of the first liquid-feeding pump 341. That is, it is possible to change the rate at which a mixed dispersion including the second PE resin particles and the second StAc resin particles is added to the first aggregated particle dispersion.

In addition, the flow rate at which the dispersion is fed from the third tank 323 to the second tank 322 can be controlled by changing the output of the second liquid-feeding pump 342. That is, it is possible to change the concentration of the second StAc resin particles in the dispersion (i.e., mixed dispersion) fed from the second tank 322 to the first tank 321.

As described above, use of the power-feed addition method enables, for example, 1) the position, 2) the timing, and 3) the rate at which the mixed dispersion is added to the first aggregated particle dispersion and 4) the concentration of the second StAc resin particles in the mixed dispersion to be controlled while the mixed dispersion is added to the first aggregated particle dispersion.

A power-feed addition method is not limited to the above-described one, and various types of power-feed addition methods may be employed. For example, it is also possible to dispose a tank containing the second PE resin particle dispersion and a tank containing the mixed dispersion and feed the second PE resin particle dispersion and the mixed dispersion from the respective tanks to the first tank 321 separately.

The second aggregated particles are formed in the above-described coagulation process, in which the second resin particles and the release-agent particles are deposited on the surfaces of the first aggregated particles.

Fusion-Coalescence Step

A second aggregated particle dispersion in which the second aggregated particles are dispersed is heated to, for example, the glass transition temperatures of the first and second resin particles or more (e.g., temperature higher than the glass transition temperatures of the first and second resin particles by 10° C. to 30° C.) in order to perform fusion and coalescence of the second aggregated particles. Thus, toner particles are prepared.

The toner particles are prepared through the above-described steps.

It is also possible to prepare the toner particles by, after preparing the second aggregated particle dispersion in which the second aggregated particles are dispersed, further mixing the second aggregated particle dispersion with a resin particle dispersion in which resin particles are dispersed and subsequently performing aggregation such that the resin particles are deposited on the surfaces of the second aggregated particles in order to form third aggregated particles; and by heating a third aggregated particle dispersion in which the third aggregated particles are dispersed and thereby causing fusion and coalescence of the third aggregated particles in order to form toner particles having a core-shell structure.

After the completion of the fusion-coalescence step, the toner particles formed in the solution are subjected to a cleaning step, a solid-liquid separation step, and a drying step that are known in the related art in order to obtain dried toner particles.

In the cleaning step, the toner particles may be subjected to deformation washing using ion-exchange water to a sufficient degree from the viewpoint of electrification characteristics. Examples of a solid-liquid separation method employed in the solid-liquid separation step include, but are not limited to, suction filtration and pressure filtration from the viewpoint of productivity. Examples of a drying method employed in the drying step include, but are not particularly limited to, freeze-drying, flash drying, fluidized drying, and vibrating fluidized drying from the viewpoint of productivity.

The toner according to this exemplary embodiment is produced by, for example, adding an external additive to the dried toner particles and mixing the resulting toner particles using a V-blender, a HENSCHEL mixer, a Lodige mixer, or the like. Optionally, coarse toner particles may be removed using a vibrating screen classifier, a wind screen classifier, or the like.

Electrostatic-Image Developer

The electrostatic-image developer according to an exemplary embodiment includes at least the toner according to the above-described exemplary embodiment.

The electrostatic-image developer according to this exemplary embodiment may be a monocomponent developer including only the above-described toner or may be a two-component developer that is a mixture of the above-described toner and a carrier.

The type of the carrier is not particularly limited, and any suitable carrier known in the related art may be used. Examples of the carrier include a coated carrier prepared by coating the surfaces of cores including magnetic powder particles with a coat resin; a magnetic-powder-dispersed carrier prepared by dispersing and mixing magnetic powder particles in a matrix resin; and a resin-impregnated carrier prepared by impregnating a porous magnetic powder with a resin.

The magnetic-powder-dispersed carrier and the resin-impregnated carrier may also be prepared by coating particles constituting the carrier, that is, core particles, with a coat resin.

Examples of the magnetic powder include powders of magnetic metals such as iron, nickel, and cobalt; and powders of magnetic oxides such as ferrite and magnetite.

Examples of the coat resin and the matrix resin include polyethylene, polypropylene, polystyrene, poly(vinyl acetate), poly(vinyl alcohol), poly(vinyl butyral), poly(vinyl chloride), poly(vinyl ether), poly(vinyl ketone), a vinyl chloride-vinyl acetate copolymer, a styrene-acrylic acid copolymer, a straight silicone resin including an organosiloxane bond and the modified products thereof, a fluorine resin, polyester, polycarbonate, a phenolic resin, and an epoxy resin.

The coat resin and the matrix resin may optionally include additives such as conductive particles.

Examples of the conductive particles include particles of metals such as gold, silver, and copper; and particles of carbon black, titanium oxide, zinc oxide, tin oxide, barium sulfate, aluminium borate, and potassium titanate.

The surfaces of the cores can be coated with a coat resin by, for example, using a coating-layer forming solution prepared by dissolving the coat resin and, as needed, various types of additives in a suitable solvent. The type of the solvent is not particularly limited and may be selected with consideration of the coat resin used, ease of applying the coating-layer forming solution, and the like.

Specific examples of a method for coating the surfaces of the cores with the coat resin include an immersion method in which the cores are immersed in the coating-layer forming solution; a spray method in which the coating-layer forming solution is sprayed onto the surfaces of the cores; a fluidized-bed method in which the coating-layer forming solution is sprayed onto the surfaces of the cores while the cores are floated using flowing air; and a kneader-coater method in which the cores of the carrier are mixed with the coating-layer forming solution in a kneader coater and subsequently the solvent is removed.

The mixing ratio (i.e., mass ratio) of the toner to the carrier in the two-component developer is preferably set to [toner]:[carrier]=1:100 to 30:100 and is more preferably set to 3:100 to 20:100.

Image Forming Apparatus and Image Forming Method

The image forming apparatus and the image forming method according to an exemplary embodiment are described below.

The image forming apparatus according to this exemplary embodiment includes an image carrier; a charging unit that charges the surface of the image carrier; an electrostatic-image forming unit that forms an electrostatic image on the surface of the image carrier charged; a developing unit that includes an electrostatic-image developer and develops the electrostatic image formed on the surface of the image carrier using the electrostatic-image developer to form a toner image; a transfer unit that transfers the toner image formed on the surface of the image carrier onto the surface of a recording medium; a cleaning unit including a cleaning blade with which the surface of the image carrier is cleaned; and a fixing unit that fixes the toner image onto the surface of the recording medium. The electrostatic-image developer according to the above-described exemplary embodiment is used as an electrostatic-image developer.

The image forming apparatus according to this exemplary embodiment employs an image forming method (image forming method according to an exemplary embodiment) including charging the surface of the image carrier; forming an electrostatic image on the surface of the charged image carrier; developing the electrostatic image formed on the surface of the image carrier using the electrostatic-image developer according to the above-described exemplary embodiment to form a toner image; transferring the toner image formed on the surface of the image carrier onto the surface of a recording medium; cleaning the surface of the image carrier with a cleaning blade; and fixing the toner image onto the surface of the recording medium.

The image forming apparatus according to this exemplary embodiment may be any image forming apparatus known in the related art, such as a direct-transfer-type image forming apparatus in which a toner image formed on the surface of the image carrier is directly transferred to a recording medium; an intermediate-transfer-type image forming apparatus in which a toner image formed on the surface of the image carrier is transferred onto the surface of the intermediate transfer body in the first transfer step and the toner image transferred on the surface of the intermediate transfer body is again transferred onto the surface of a recording medium in the second transfer step; and an image forming apparatus including a static-eliminating unit that eliminates static by irradiating, after the toner image has been transferred, the surface of the image carrier to be again charged with static-eliminating light.

The intermediate-transfer-type image forming apparatus may include a transfer unit constituted by, for example, an intermediate transfer body to which a toner image is transferred, a first transfer subunit that transfers a toner image formed on the surface of the image carrier onto the surface of the intermediate transfer body in the first transfer step, and a second transfer subunit that transfers the toner image transferred on the surface of the intermediate transfer body onto the surface of a recording medium in the second transfer step.

In the image forming apparatus according to this exemplary embodiment, for example, a portion including the developing unit may have a cartridge structure (i.e., process cartridge) detachably attached to the image forming apparatus. An example of the process cartridge is a process cartridge including a developing unit including the electrostatic-image developer according to the above-described exemplary embodiment.

An example of the image forming apparatus according to this exemplary embodiment is described below, but the image forming apparatus is not limited thereto. Only components shown in drawings are described; others are omitted.

FIG. 1 schematically illustrates the image forming apparatus according to this exemplary embodiment.

The image forming apparatus illustrated in FIG. 1 includes first to fourth electrophotographic image forming units 10Y, 10M, 10C, and 10K that form yellow (Y), magenta (M), cyan (C), and black (K) images, respectively, on the basis of color separation image data. The image forming units (hereafter, referred to simply as "units") 10Y, 10M, 10C, and 10K are horizontally arranged in parallel at a predetermined distance from one another. The units 10Y, 10M, 10C, and 10K may be process cartridges detachably attached to the image forming apparatus.

An intermediate transfer belt 20 serving as an intermediate transfer body runs above and extends over the units 10Y, 10M, 10C, and 10K in FIG. 1. The intermediate transfer belt 20 is wound around a drive roller 22 and a support roller 24, which are spaced apart from each other and brought into contact with the inner surface of the intermediate transfer belt 20. The intermediate transfer belt 20 runs clockwise in FIG. 1, i.e., in the direction from the first unit 10Y to the fourth unit 10K. Using a spring or the like (not shown), a force is applied to the support roller 24 in a direction away from the drive roller 22, thereby applying tension to the intermediate transfer belt 20 wound around the drive roller 22 and the support roller 24. An intermediate transfer body-cleaning device 30 is disposed so as to come into contact with the image-carrier-side surface of the intermediate transfer belt 20 and to face the drive roller 22.

Developing devices (i.e., developing units) 4Y, 4M, 4C, and 4K of units 10Y, 10M, 10C, and 10K are supplied with yellow, magenta, cyan, and black toners stored in toner cartridges 8Y, 8M, 8C, and 8K, respectively.

Since the first to fourth units 10Y, 10M, 10C, and 10K have the same structure, the following description is made with reference to, as a representative, the first unit 10Y that forms an yellow image and is located upstream in a direction in which the intermediate transfer belt runs. Same members are labeled with the same reference numeral as the reference numeral of the first unit 10Y except that magenta (M), cyan (C), or black (K) is used instead of yellow (Y) and the description of the second to fourth units 10M, 10C, and 10K are omitted.

The first unit 10Y includes a photosensitive member 1Y serving as an image carrier. The following components are disposed around the photosensitive member 1Y sequentially in the counterclockwise direction: a charging roller (example of the charging unit) 2Y that charges the surface of the photosensitive member 1Y at a predetermined potential; an exposure device (example of the electrostatic-image forming unit) 3 that forms an electrostatic image by irradiating the charged surface of the photosensitive member 1Y with a laser beam 3Y based on a color separated image signal; a developing device (example of the developing unit) 4Y that develops the electrostatic image by supplying a charged toner to the electrostatic image; a first transfer roller (example of the first transfer subunit) 5Y that transfers the developed toner image to the intermediate transfer belt 20; and a photosensitive-member cleaning device (example of the cleaning unit) 6Y including a cleaning blade 6Y-1, which removes a toner remaining on the surface of the photosensitive member 1Y after the first transfer.

The first transfer roller 5Y is disposed so as to be in contact with the inner surface of the intermediate transfer belt 20 and to face the photosensitive member 1Y. The first transfer rollers 5Y, 5M, 5C, and 5K are each connected to a bias power supply (not shown) that applies a first transfer bias to the first transfer rollers. Each bias power supply varies the transfer bias applied to the corresponding first transfer roller on the basis of the control by a controller (not shown).

The photosensitive member cleaning device 6Y includes a cleaning blade 6Y-1, which is brought into contact with the peripheral surface of the photosensitive member 1Y so as to rub off (i.e., scratch off) toner particles that remain on the photosensitive member 1Y after transfer.

The cleaning blade 6Y-1 is a tabular (i.e., blade like) member composed of an elastic material or the like. Examples of the elastic material include a thermosetting polyurethane rubber, a silicone rubber, a fluorine rubber, and an ethylene-propylene-diene rubber.

The cleaning blade 6Y-1 is arranged such that, for example, an edge of the cleaning blade 6Y-1 which is proximal to the photosensitive member 1Y is oriented to a direction opposite to the direction of rotation of the photosensitive member 1Y.

The action of forming a yellow image in the first unit 10Y is described below.

Before the action starts, the surface of the photosensitive member 1Y is charged at a potential of −600 to −800 V by the charging roller 2Y.

The photosensitive member 1Y is formed by stacking a photosensitive layer on a conductive substrate (e.g., volume resistivity at 20° C.: $1\times10^{-6}$ Ωcm or less). The photosensitive layer is normally of high resistance (comparable with the resistance of ordinary resins), but, upon being irradiated with the laser beam 3Y, the specific resistance of the portion irradiated with the laser beam varies. Thus, the exposure device 3 irradiates the surface of the charged photosensitive member 1Y with the laser beam 3Y on the basis of the image data of the yellow image sent from the controller (not shown). The photosensitive layer on the surface of the photosensitive member 1Y is irradiated with the laser beam 3Y, and thereby an electrostatic image of yellow image pattern is formed on the surface of the photosensitive member 1Y.

The term "electrostatic image" used herein refers to an image formed on the surface of the photosensitive member 1Y by charging, the image being a "negative latent image" formed by irradiating a portion of the photosensitive layer with the laser beam 3Y to reduce the specific resistance of the irradiated portion such that the charges on the irradiated surface of the photosensitive member 1Y discharge while the charges on the portion that is not irradiated with the laser beam 3Y remain.

The electrostatic image, which is formed on the photosensitive member 1Y as described above, is sent to the predetermined developing position by the rotating photosensitive member 1Y. The electrostatic image on the photosensitive member 1Y is visualized (i.e., developed) in the form of a toner image by the developing device 4Y at the developing position.

The developing device 4Y includes an electrostatic-image developer including, for example, at least a yellow toner and a carrier. The yellow toner is stirred in the developing device 4Y to be charged by friction and supported on a developer roller (example of the developer support), carrying an electric charge of the same polarity (i.e., negative) as the electric charge generated on the photosensitive member 1Y. The yellow toner is electrostatically adhered to the eliminated latent image portion on the surface of the photosensitive member 1Y as the surface of the photosensitive member 1Y passes through the developing device 4Y. Thus, the latent image is developed using the yellow toner. The photosensitive member 1Y on which the yellow toner image is formed keeps rotating at the predetermined rate, thereby transporting the toner image developed on the photosensitive member 1Y to the predetermined first transfer position.

Upon the yellow toner image on the photosensitive member 1Y reaching the first transfer position, first transfer bias is applied to the first transfer roller 5Y so as to generate an electrostatic force on the toner image in the direction from the photosensitive member 1Y toward the first transfer roller 5Y. Thus, the toner image on the photosensitive member 1Y is transferred to the intermediate transfer belt 20. The transfer bias applied has the opposite polarity (+) to that of the toner (−) and controlled to be, for example, in the first unit 10Y, +10 FA by a controller (not shown).

The toner remaining on the photosensitive member 1Y is removed by the photosensitive-member cleaning device 6Y and then collected.

The first transfer biases applied to first transfer rollers 5M, 5C, and 5K of the second, third, and fourth units 10M, 10C, and 10K are each controlled in accordance with the first unit 10Y.

Thus, the intermediate transfer belt 20, on which the yellow toner image is transferred in the first unit 10Y, is successively transported through the second to fourth units 10M, 10C, and 10K while toner images of the respective colors are superimposed on top of another.

The resulting intermediate transfer belt 20 on which toner images of four colors are multiple-transferred in the first to fourth units is then transported to a second transfer section including a support roller 24 being in contact with the inner surface of the intermediate transfer belt 20 and a second transfer roller (example of the second transfer subunit) 26 disposed on the image-carrier-side of the intermediate transfer belt 20. A recording paper (example of the recording medium) P is fed by a feed mechanism into a narrow space between the second transfer roller 26 and the intermediate transfer belt 20 that are brought into contact with each other at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording paper P. Thus, the toner image on the intermediate transfer belt 20 is transferred to the recording paper P. The intensity of the second transfer bias applied is determined on the basis of the resistance of the second transfer section which is detected by a resistance detector (not shown) that detects the resistance of the second transfer section and controlled by changing voltage.

Subsequently, the recording paper P is transported into a nip part of the fixing device (example of the fixing unit) 28 at which a pair of fixing rollers are brought into contact with each other. The toner image is fixed to the recording paper P to form a fixed image.

Examples of the recording paper P to which a toner image is transferred include plain paper used in electrophotographic copiers, printers, and the like. Examples of a recording medium other than the recording paper P include OHP films.

In order to enhance the smoothness of the surface of the fixed image, the surface of the recording paper P may also be smooth. Examples of such a recording paper include coated paper produced by coating the surface of plain paper with resin or the like and art paper for printing.

The recording paper P, to which the color image has been fixed, is transported toward an exit portion. Thus, the series of the steps for forming a color image are terminated.

Process Cartridge and Toner Cartridge

The process cartridge according to an exemplary embodiment is described below.

The process cartridge according to this exemplary embodiment includes a developing unit that includes the electrostatic-image developer according to the above-described exemplary embodiment and develops an electrostatic image formed on the surface of an image carrier using the electrostatic-image developer to form a toner image. The process cartridge according to this exemplary embodiment is detachably attachable to an image forming apparatus.

The structure of the process cartridge according to this exemplary embodiment is not limited to the above-described one. The process cartridge according to this exemplary embodiment may further include, in addition to the developing unit, at least one unit selected from an image carrier, a charging unit, an electrostatic-image forming unit, a transfer unit, and the like as needed.

An example of the process cartridge according to this exemplary embodiment is described below, but the process cartridge is not limited thereto. Only components illustrated in FIG. 2 are described; others are omitted.

Figure 2:
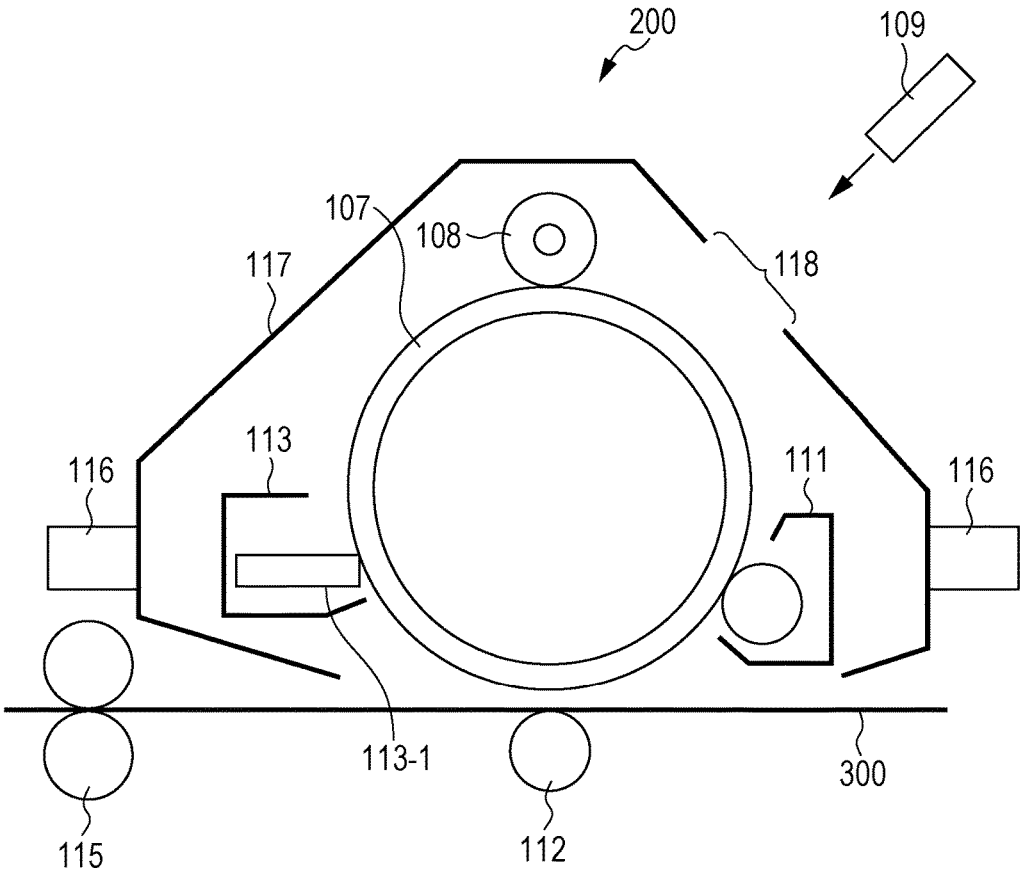
FIG. 2 is a schematic diagram illustrating an example of a process cartridge according to an exemplary embodiment.

FIG. 2 schematically illustrates the process cartridge according to this exemplary embodiment.

A process cartridge 200 illustrated in FIG. 2 includes, for example, a photosensitive member 107 (example of the image carrier), a charging roller 108 (example of the charging unit) disposed on the periphery of the photosensitive member 107, a developing device 111 (example of the developing unit), and a photosensitive-member-cleaning device 113 (example of the cleaning unit) including a cleaning blade 113-1, which are combined into one unit using a housing 117 to form a cartridge. The housing 117 has an aperture 118 for exposure. A mounting rail 116 is disposed on the housing 117.

In FIG. 2, Reference numeral 109 denotes an exposure device (example of the electrostatic-image forming unit), Reference numeral 112 denotes a transfer device (example of the transfer unit), Reference numeral 115 denotes a fixing device (example of the fixing unit), and the Reference numeral 300 denotes recording paper (example of the recording medium).

The toner cartridge according to an exemplary embodiment is described below.

The toner cartridge according to this exemplary embodiment includes the toner according to the above-described exemplary embodiment and is detachably attachable to an image forming apparatus. The toner cartridge includes a toner that is to be supplied to a developing unit disposed inside an image forming apparatus.

The image forming apparatus illustrated in FIG. 1 includes toner cartridges 8Y, 8M, 8C, and 8K detachably attached thereto. Developing devices 4Y, 4M, 4C, and 4K are each connected to the toner cartridge associated with each developing device (i.e., each color) through a toner supply tube (not shown). The toner cartridge is exchanged when the amount of toner stored in the toner cartridge is small.

EXAMPLES

The foregoing exemplary embodiments are described below more specifically with reference to Examples. However, the exemplary embodiments are not limited by Examples below. In Examples, all "parts" and "%" are on a mass basis unless otherwise specified.

Preparation of Polyester Resin Particle Dispersion

Terephthalic acid: 30 molar parts
Fumaric acid: 70 molar parts
Bisphenol A-ethylene oxide adduct: 5 molar parts
Bisphenol A-propylene oxide adduct: 95 molar parts The above materials are charged into a flask having an inner capacity of 5 L which is equipped with a stirrer, a nitrogen introduction tube, a temperature sensor, and a rectifying column. Subsequently, the flask is heated to 210° C. over 1 hour, and titanium tetraethoxide is added to the flask such that the amount of titanium tetraethoxide is 1 part relative to 100 parts of the total amount of the above materials. Then, the flask is heated to 230° C. over 0.5 hours while the water produced by the reaction is distilled away. After the dehydration condensation reaction has been conducted for 1 hour at 230° C., the resulting reaction product is cooled. Thus, a polyester resin (1) having a weight-average molecular weight of 18,500, an acid value of 14 mgKOH/g, and a glass transition temperature of 59° C. is synthesized.

Into a container equipped with a temperature-controlling unit and a nitrogen-purging unit, 40 parts of ethyl acetate and 25 parts of 2-butanol are charged. To the resulting mixed solvent of ethyl acetate and 2-butanol, 100 parts of the polyester resin (1) is gradually added so as to dissolve in the mixed solvent. Subsequently, a 10-mass % aqueous ammonia solution (in an amount three times the acid value of the resin in terms of molar ratio) is added to the container, and the resulting mixture is stirred for 30 minutes.

After the container is purged with a dry nitrogen gas, 400 parts of ion-exchange water is added dropwise to the container at a rate of 2 part/min in order to perform emulsification while the temperature of the container is maintained to be 40° C. and the liquid mixture is stirred. After the addition of ion-exchange water is completed, the temperature of the emulsion is reduced to the room temperature (i.e., 20° C. to 25° C.). The resulting emulsion is subjected to bubbling for 48 hours with a dry nitrogen gas while being stirred such that the concentration of ethyl acetate and 2-butanol is reduced to 1,000 ppm or less. Thus, a resin particle dispersion in which resin particles having a volume-average diameter of 200 nm are dispersed is prepared. Ion-exchange water is added to the resin particle dispersion such that the solid content in the resin particle dispersion is 20% by mass. Thus, a polyester resin particle dispersion (1) is prepared.

Preparation of Styrene-Acrylic Resin Particle Dispersion

Styrene: 77 parts
n-Butyl acrylate: 23 parts
1,10-Decanediol diacrylate: 0.4 parts
Dodecanethiol: 0.7 parts A solution prepared by dissolving 1.0 parts of an anionic surfactant "DOCWFAX" produced by The Dow Chemical Company in 60 parts of ion-exchange water is added to a solution of the above materials. Dispersion and emulsification of the resulting mixture are performed in order to prepare an emulsion of the above monomers.

In 90 parts of ion-exchange water, 2.0 parts of an anionic surfactant "DOWFAX" produced by The Dow Chemical Company is dissolved. To the resulting solution, 2.0 parts of the emulsion of the monomers is added, and a solution prepared by dissolving 1.0 parts of ammonium persulfate in 10 parts of ion-exchange water is further added.

The remaining portion of the emulsion of the monomers is added to the flask over 3 hours. After the flask is purged with nitrogen, the solution contained in the flask is heated to 65° C. with an oil bath while being stirred in order to perform emulsion polymerization. The emulsion polymerization reaction is continued for 5 hours. Thus, a styrene-acrylic resin particle dispersion (1) is prepared. The solid content of the styrene-acrylic resin particle dispersion (1) is adjusted to be 32% by addition of ion-exchange water.

The particles included in the styrene-acrylic resin particle dispersion (1) have a volume-average diameter of 102 nm and a weight-average molecular weight of 55,000.

Preparation of Colorant Particle Dispersion

Cyan pigment, C.I. Pigment Blue 15:3 (copper phthalocyanine, "FASTOGEN BLUE LA5380" produced by DIC corporation): 70 parts
Anionic surfactant "NEOGEN RK" produced by Dai-ichi Kogyo Seiyaku Co., Ltd.: 5 parts
Ion-exchange water: 200 parts The above materials are mixed together, and the resulting mixture is stirred for 10 minutes with a homogenizer "ULTRA-TURRAX T50" produced by IKA to form a dispersion. Ion-exchange water is added to the dispersion such that the solid content in the dispersion becomes 20% by mass. Thus, a colorant particle dispersion (1) in which colorant particles having a volume-average diameter of 190 nm are dispersed is prepared.

Preparation of Release-Agent Particle Dispersion

Paraffin wax "HNP-9" produced by Nippon Seiro Co., Ltd.: 100 parts
Anionic surfactant "NEOGEN RK" produced by Dai-ichi Kogyo Seiyaku Co., Ltd.: 1 part
Ion-exchange water: 350 parts A mixture of the above materials is heated to 100° C. and subsequently stirred with a homogenizer "ULTRA-TURRAX T50" produced by IKA to form a dispersion. The dispersion is further subjected to a Manton Gaulin high-pressure homogenizer produced by Gaulin Company. Thus, a release-agent particle dispersion (1) (solid content: 20 mass %) in which release-agent particles having a volume-average diameter of 200 nm are dispersed is prepared.

Example 1

Preparation of Toner Particles

An apparatus including a round, stainless steel flask and containers A and B is prepared (see FIG. 3). The stainless steel flask is connected to the containers A with a tube pump A, through which a liquid contained in the container A is fed to the flask upon the tube pump A being driven. The container A is connected to the container B with a tube pump B, through which a liquid contained in the container B is fed to the container A upon the tube pump B being driven. The following operations are performed with the above apparatus.

The polyester resin particle dispersion (1): 490 parts

The styrene-acrylic resin particle dispersion (1): 10 parts

The colorant particle dispersion (1): 40 parts

The release-agent particle dispersion (1): 30 parts

Anionic surfactant "TAYCAPOWER": 2 parts

The above materials are charged into the round, stainless steel flask. After the pH of the resulting mixture is adjusted to be 3.5 by addition of 0.1-N nitric acid, 30 parts of a nitric acid aqueous solution including 10% by mass of polyaluminium chloride is added to the flask. After the resulting mixture has been stirred at 30° C. with a homogenizer "ULTRA-TURRAX T50" produced by IKA to form a dispersion, the flask is placed in a heating oil bath and heated at a rate of 1° C./30 min in order to increase the diameter of the aggregated particles.

In the container A, which is a polyester bottle, 160 parts of the polyester resin particle dispersion (1) is charged. In the container B, 40 parts of the styrene-acrylic resin particle dispersion (1) is charged.

The flow rate at which a liquid is fed by the tube pump A is set to 0.55 part/min. The flow rate at which a liquid is fed by the tube pump B is set to 0.15 part/min. Feeding of the dispersions contained in the containers is started by driving the tube pumps A and B when the temperature inside the round, stainless steel flask, in which the formation of aggregated particles is proceeding, reaches 37.0° C. The liquid contained in the container A is added dropwise to the flask so as to flow along the wall of the flask. In this manner, a mixed dispersion including the polyester resin particles and the styrene-acrylic resin particles is fed from the container A into the round, stainless steel flask, in which the formation of aggregated particles is proceeding, while the concentration of the styrene-acrylic resin particles in the mixed dispersion is increased gradually.

After the feeding of the dispersions to the flask has been completed, the contents of the flask are maintained for 30 minutes since the temperature include the flask reached 48° C. to form second aggregated particles.

To the flask, 50 parts of the polyester resin particle dispersion (1) is gradually added. After the flask is maintained for 1 hour, a 0.1-N aqueous sodium hydroxide solution is added to the flask such that the pH of the contents of the flask reaches 8.5. While being stirred, the contents of the flask are heated to 85° C. and maintained at 85° C. for 5 hours. The contents of the flask are subsequently cooled to 20° C. at a rate of 20° C./min, filtered, cleaned with ion-exchange water to a sufficient degree, and dried to form toner particles (1) having a volume-average diameter of 6.0 μm.

Preparation of Toner

A toner (1) is prepared by mixing 100 parts of the toner particles (1) with 0.7 parts of silica particles treated with dimethyl silicone oil, "RY200" produced by Nippon Aerosil Co., Ltd. by using a Henschel mixer (circumferential velocity: 30 m/sec, 3 minutes).

Preparation of Developer

Ferrite particles (average diameter: 50 μm): 100 parts

Toluene: 14 parts

Styrene/methyl methacrylate copolymer (copolymerization ratio: 15/85): 3 parts

Carbon black: 0.2 parts

The above components other than the ferrite particles are mixed together with a sand mill to form a dispersion. The dispersion is charged into a vacuum-deaeration kneader together with the ferrite particles. While being stirred, the resulting mixture is dried under a reduced pressure to form a carrier.

With 100 parts of the carrier, 8 parts of the toner (1) is mixed. Thus, a developer (1) is prepared.

Example 2

Toner particles (2) are prepared as in Example 1, except that the flow rate at which a liquid is fed by the tube pump B is changed to 0.20 part/min, and the temperature inside the flask at which the tube pumps A and B are actuated is changed to 39.0° C. The toner particles (2) have a volume-average diameter of 5.9 μm. A toner (2) and a developer (2) are prepared from the toner particles (2) as in Example 1.

Example 3

Toner particles (3) are prepared as in Example 1, except that the flow rate at which a liquid is fed by the tube pump B is changed to 0.20 part/min, and the temperature inside the flask at which the tube pumps A and B are actuated is changed to 35.0° C. The toner particles (3) have a volume-average diameter of 5.8 μm. A toner (3) and a developer (3) are prepared from the toner particles (3) as in Example 1.

Example 4

Toner particles (4) are prepared as in Example 1, except that the flow rate at which a liquid is fed by the tube pump A is changed to 0.40 part/min, and the flow rate at which a liquid is fed by the tube pump B is changed to 0.20 part/min. The toner particles (4) have a volume-average diameter of 5.7 μm. A toner (4) and a developer (4) are prepared from the toner particles (4) as in Example 1.

Example 5

Toner particles (5) are prepared as in Example 1, except that the flow rate at which a liquid is fed by the tube pump A is changed to 0.65 part/min, and the position at which a liquid contained in the container A is added dropwise to the flask is changed to along the rotating shaft inside the flask. The toner particles (5) have a volume-average diameter of 6.0 μm. A toner (5) and a developer (5) are prepared from the toner particles (5) as in Example 1.

Comparative Example 1

Comparative toner particles (C1) are prepared as in Example 1, except that the flow rate at which a liquid is fed by the tube pump A is changed to 0.60 part/min, the flow rate at which a liquid is fed by the tube pump B is changed to 0.25 part/min, and the temperature inside the flask at which the tube pumps A and B are actuated is changed to 40.0° C. The comparative toner particles (C1) have a volume-average diameter of 5.8 μm. A comparative toner (C1) and a comparative developer (C1) are prepared from the comparative toner particles (C1) as in Example 1.

Comparative Example 2

Comparative toner particles (C2) are prepared as in Example 1, except that the flow rate at which a liquid is fed by the tube pump B is changed to 0.25 part/min, and the temperature inside the flask at which the tube pumps A and B are actuated is changed to 34.0° C. The comparative toner particles (C2) have a volume-average diameter of 6.1 μm. A comparative toner (C2) and a comparative developer (C2) are prepared from the comparative toner particles (C2) as in Example 1.

Comparative Example 3

Comparative toner particles (C3) are prepared as in Example 1, except that the flow rate at which a liquid is fed by the tube pump A is changed to 0.35 part/min, and the flow rate at which a liquid is fed by the tube pump B is changed to 0.20 part/min. The comparative toner particles (C3) have a volume-average diameter of 5.9 μm. A comparative toner (C3) and a comparative developer (C3) are prepared from the comparative toner particles (C3) as in Example 1.

Comparative Example 4

Comparative toner particles (C4) are prepared as in Example 1, except that the flow rate at which a liquid is fed by the tube pump A is changed to 0.70 part/min, and the position at which a liquid contained in the container A is added dropwise to the flask is changed to along the rotating shaft inside the flask. The comparative toner particles (C4) have a volume-average diameter of 5.8 μm. A comparative toner (C4) and a comparative developer (C4) are prepared from the comparative toner particles (C4) as in Example 1.

Evaluations

The developers prepared in Examples and Comparative Examples above are each subjected to the following evaluations. Table 1 summarizes the results.

The developers prepared in Examples and Comparative Examples above are each charged into a developing device included in an image forming apparatus "700 DIGITAL COLOR PRESS" produced by Fuji Xerox Co., Ltd. which has been modified such that the contact pressure of a cleaning blade is 12 mN/mm. A makeup toner, which is the same toner as that included in the developer, is charged into a toner cartridge of the image forming apparatus.

A solid image having a high area coverage (100%) is printed on 100 A4 paper sheets with the image forming apparatus in an environment of 10° C. and 15% RH. The image printed on the 100th sheet is inspected visually or through a loupe with a 100 power magnification for the presence of the streaky image defects. Hereinafter, this evaluation is referred to as "high-area-coverage evaluation".

A halftone image having a low area coverage (10%) is printed on 100 A4 paper sheets, and an evaluation of streaky image defects is made as in the high-area-coverage evaluation. Hereinafter, this evaluation is referred to as "low-area-coverage evaluation".

While the high-area-coverage evaluation and the low-area-coverage evaluation are made, the condition of the cleaning blade is also inspected with a laser microscope and evaluated in accordance with the following criteria.

Criteria for High-Area-Coverage Evaluation and Low-Area-Coverage Evaluation

A: No streaky irregularities are found in the observation of the image with a loupe with a 100 power magnification.

B: Streaky irregularities are confirmed on the image by using a loupe with a 100 power magnification.

C: Streaky irregularities are visually confirmed on the image, but they do not impair the use of the image forming apparatus.

D: Plural streaky image defects are confirmed visually on the image, and they impair the use of the image forming apparatus.

Criteria for Evaluating Condition of Cleaning Blade

A: No chip is formed on the edge of the cleaning blade.

B: The number of chips formed on the edge of the cleaning blade which have a size of 10 μm or more per square centimeter is 0.

C: The number of chips formed on the edge of the cleaning blade which have a size of 10 μm or more per square centimeter is 1 to 4.

D: The number of chips formed on the edge of the cleaning blade which have a size of 10 μm or more per square centimeter is 5 or more.

TABLE 1

| | Toner | | Evaluations | | |
|---|---|---|---|---|---|
| | Median of distribution of ratios (%) of deformations of toner particles to diameters of toner particles | Variation in distribution of deformation ratios | High-area-coverage evaluation | Low-area-coverage evaluation | Evaluation of condition of cleaning blade |
| Example 1 | 14.0 | 0.20 | A | A | A |
| Example 2 | 8.1 | 0.21 | A | C | B |
| Example 3 | 17.9 | 0.19 | C | A | B |
| Example 4 | 13.5 | 0.02 | B | B | A |
| Example 5 | 14.2 | 0.40 | A | A | B |
| Comparative example 1 | 7.8 | 0.22 | C | D | C |
| Comparative example 2 | 18.2 | 0.24 | D | B | B |

TABLE 1-continued

| | Toner | | Evaluations | | |
|---|---|---|---|---|---|
| | Median of distribution of ratios (%) of deformations of toner particles to diameters of toner particles | Variation in distribution of deformation ratios | High-area-coverage evaluation | Low-area-coverage evaluation | Evaluation of condition of cleaning blade |
| Comparative example 3 | 13.7 | 0.01 | D | D | B |
| Comparative example 4 | 13.8 | 0.42 | C | B | D |

The above results confirm that the toners prepared in Examples are evaluated as good in terms of the high-area-coverage evaluation and the low-area-coverage evaluation compared with those prepared in Comparative Examples. This confirms that the toners prepared in Examples may reduce the likelihood of the streaky image defects being formed in the direction of rotation of the image carrier when images having different area coverages are formed in a low-temperature, low-humidity environment with an image forming apparatus including a cleaning blade that is in contact with a photosensitive member at a low contact pressure compared with the toners prepared in Comparative Examples.

The toners prepared in Examples are also evaluated as good in terms of the condition of the cleaning blade.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic-image developing toner comprising:

toner particles, produced by a process comprising:

forming first aggregated particles by mixing together at least a first polyester resin particle dispersion comprised of first polyester resin particles and a first styrene (meth)acrylic resin particle dispersion comprised of styrene (meth)acrylic resin particles, and subsequently coagulating the mixture, forming second aggregated particles by adding to a dispersion of the first aggregated particles a mixed dispersion comprised of second polyester resin particles and second styrene (meth)acrylic resin particles, the second polyester resin particles and the second styrene (meth)acrylic resin particles depositing on a surface of the first aggregated particles, and fusion coalescing the second aggregated particles to form the toner particles, wherein during the forming of the second aggregated particles, a concentration of the second styrene (meth)acrylic resin particles in the mixed dispersion added to the dispersion of the first aggregated particles is increased over time, wherein in a micro-compression test where a load of 0.2 mN is applied to the toner particles at a loading rate of 0.098 mN/sec:

the median of a distribution of the ratios (%) of deformations of the toner particles to diameters of the toner particles is 8.0 or more and 18.0 or less, and a variation in the distribution of the ratios of deformations of the toner particles to the diameters of the toner particles is 0.02 or more and 0.40 or less.

2. The electrostatic-image developing toner according to claim 1, wherein the first polyester resin particles and the second polyester resin particles are each comprised of a polyester resin having a glass transition temperature Tg of 50° C. or more and 80° C. or less.

3. The electrostatic-image developing toner according to claim 1, wherein the first polyester resin particles and the second polyester resin particles are each comprised of a polyester resin having a weight-average molecular weight Mw of 5,000 or more and 1,000,000 or less.

4. The electrostatic-image developing toner according to claim 1, wherein the first polyester resin particles and the second polyester resin particles are each comprised of a polyester resin having a molecular weight distribution Mw/Mn of 1.5 or more and 100 or less.

5. The electrostatic-image developing toner according to claim 1, wherein the first styrene (meth)acrylic resin particles and the second styrene (meth)acrylic resin particles are each comprised of a styrene (meth)acrylic resin produced by copolymerization of a styrene-based polymerizable monomer with a (meth)acrylic acid-based polymerizable monomer at a copolymerization ratio (styrene-based polymerizable monomer)/((meth) acrylic acid-based polymerizable monomer) of 85/15 to 70/30 by mass.

6. The electrostatic-image developing toner according to claim 1, wherein the first styrene (meth)acrylic resin particles and the second styrene (meth)acrylic resin particles each includes a crosslinked structure.

7. The electrostatic-image developing toner according to claim 6, wherein a copolymerization ratio of a crosslinkable monomer to all monomers constituting the styrene (meth)acrylic resin is 2/1000 to 30/1000 by mass.

8. The electrostatic-image developing toner according to claim 1, wherein the first styrene (meth)acrylic resin particles and the second styrene (meth)acrylic resin particles are each comprised of a styrene (meth)acrylic resin having a glass transition temperature Tg of 50° C. or more and 75° C. or less.

9. The electrostatic-image developing toner according to claim 1, wherein the first styrene (meth)acrylic resin particles and the second styrene (meth)acrylic resin particles are each comprised of a styrene (meth)acrylic resin having a weight-average molecular weight of 30,000 or more and 200,000 or less.

10. The electrostatic-image developing toner according to claim 1, wherein a binder resin of the toner particles is comprised of (i) polyester resin of the first polyester resin particles and the second polyester resin particles and (ii) styrene (meth)acrylic resin of the first styrene (meth)acrylic resin particles and the second styrene (meth)acrylic resin particles, and the binder resin is 40% by mass or more and 95% by mass or less of the total amount of the toner particles.

11. The electrostatic-image developing toner according to claim 10, wherein in the binder resin, an overall ratio of an amount of polyester resin to an amount of styrene (meth)acrylic resin is 80/20 or more and 99/1 or less.

12. The electrostatic-image developing toner according to claim 1, wherein the toner particles each include a release agent having a melting temperature of 50° C. or more and 110° C. or less.

13. The electrostatic-image developing toner according to claim 12, wherein the content of the release agent is 1% by mass or more and 20% by mass or less of the total amount of the toner particles.

14. The electrostatic-image developing toner according to claim 1, wherein the toner particles each include a colorant, the amount of the colorant being 1% by mass or more and 30% by mass or less of the total amount of the toner particles.

15. The electrostatic-image developing toner according to claim 1, wherein the toner particles have a shape factor SF1 of 110 or more and 150 or less.

16. The electrostatic-image developing toner according to claim 1, wherein the toner particles each include an external additive, the amount of the external additive being 0.01% by mass or more and 5% by mass or less of the total amount of the toner particles.

17. An electrostatic-image developer comprising the electrostatic-image developing toner according to claim 1.

18. The electrostatic-image developer according to claim 17, further comprising a carrier including a resin coating, the resin coating including a resin and carbon black.

19. A toner cartridge detachably attachable to an image forming apparatus, the toner cartridge comprising the electrostatic-image developing toner according to claim 1.

20. The electrostatic-image developing toner according to claim 1, wherein the toner particles further comprise a shell.

* * * * *